US005488396A

United States Patent [19]

Burke et al.

[11] Patent Number: 5,488,396

[45] Date of Patent: Jan. 30, 1996

[54] PRINTER PRINT HEAD POSITIONING APPARATUS AND METHOD

[75] Inventors: Edward F. Burke, Lake Oswego; Randy C. Karambelas, Milwaukie, both of Oreg.

[73] Assignee: Tektronix, Inc., Wilsonville, Oreg.

[21] Appl. No.: 206,998

[22] Filed: Mar. 7, 1994

[51] Int. Cl.[6] ..... B41J 11/20

[52] U.S. Cl. ..... 347/37; 347/41

[58] Field of Search ..... 347/37, 16, 19, 347/40, 41

[56] References Cited

U.S. PATENT DOCUMENTS

| | | | |
|---|---|---|---|
| 4,538,156 | 8/1985 | Durkee et al. | 34/103 |
| 4,734,868 | 3/1988 | Delacy | 346/518 |
| 4,939,440 | 7/1990 | Burke | 318/646 |
| 4,957,014 | 9/1990 | Burke | 74/89.22 |
| 5,036,266 | 7/1991 | Burke | 318/646 |
| 5,227,809 | 7/1993 | Carpenter et al. | 347/8 |

*Primary Examiner*—Benjamin R. Fuller
*Assistant Examiner*—Craig A. Hallacher
*Attorney, Agent, or Firm*—Ralph D'Alessandro; Richard B. Preiss

[57] ABSTRACT

A print head (216) positioner (260) includes a stepper motor (264) that is coupled by a substantially friction- and backlash-free taut metal band (266) to a lever arm (268) that imparts precise lateral motion to a positioning shaft (220) that is rigidly attached to the print head assembly. Each step of the stepper motor is translated by the lever arm into one pixel (0.085 millimeter) of lateral movement of the shaft. The exact amount of translation per step of the stepper motor is adjustable by an eccentrically mounted ball (272) that is minutely positionable (274) on the lever arm. The ball couples angular motion of the lever arm to lateral motion of the shaft such that adjusting the ball position on the lever arm provides a variable scale factor adjustment that compensates for tolerance buildups and exact inter-nozzle spacing on the print head. The shaft is biased toward the ball by a spring (284). The shaft further allows the print head to swing away from a print media support, such as a drum (202), for maintenance.

21 Claims, 8 Drawing Sheets

PRINTER PRINT HEAD POSITIONING APPARATUS AND METHOD

TECHNICAL FIELD

This invention relates to printers of a type having a print head and a print medium that move relative to each other and more particularly to an apparatus and method for accurately positioning the print head in a first direction relative to motion of the print medium in a second direction.

BACKGROUND OF THE INVENTION

Many computer printers, including some low resolution ink-jet printers, scan a print head back and forth relative to a print medium to print graphics and text images thereon. Printing typically occurs while the print head is scanned in each direction, thereby employing relatively fast bidirectional printing.

An ink-jet printer ejects ink drops from the print head onto the print medium to form a printed image. The print head is typically spaced apart from the print medium, and the droplets are ejected toward the print medium at a relatively low velocity. Accordingly, there is a propagation time during which the droplets propagate from the print head to the print medium. The propagation time is dependent upon the velocity at which the droplets are ejected from the print head and the distance between the print head and the print medium.

The print head and print medium move relative to each other at a scanning velocity. A droplet projected from the moving print head will have the scanning velocity in the direction the print head is being moved. A droplet projected toward an image location on the print medium must, therefore, be ejected from the print head at an ejection time that occurs before the print head is aligned with the image location. Nominally, the ejection time precedes the alignment of the print head with the image location by about the propagation time of the droplet.

When printing takes place in only one scan direction, all droplets are subjected to the same scanning velocity. As a result, the alignment of droplets ejected during successive scans is substantially independent of the propagation time of the droplets.

In bidirectional printing, however, droplets are subjected to different scanning velocities during the successive scans in opposite directions. As a result, the alignment of droplets ejected during successive scans is dependent upon the propagation time of the droplets (i.e., the velocity at which the droplets are ejected from the print head and the distance between the print head and the print medium). Therefore, unidirectional printing provides potentially greater printing quality, albeit at a loss of printing speed.

The droplet ejection velocity can be regulated by the print head. Accordingly, the distance between the ink-jet print head and the print medium must be accurately maintained to provide adequate alignment of the droplets ejected during successive scans in opposite directions.

High-resolution ink-jet printers can form images with ink drops spaced apart by about 120 dots per centimeter. Maintaining such resolution requires that the distance between the print head and print medium be maintained within a tolerance of about ±0.05 mm. However, such printers are sometimes adapted to print onto media having a wide range of thicknesses, creating a drop alignment problem for bidirectional printing.

High-resolution ink-jet printers also require high positioning accuracy and repeatability of the print head relative to the print medium. There are many prior apparatus and methods for positioning a print head relative to a print medium. For example, in a model 4692 ink-jet printer, manufactured by the assignee of this application, a print medium is clamped to a rotating drum and the print head is moved one incremental position parallel to the axis of drum rotation for each rotation of the drum. The print head includes four nozzles aligned in the direction of drum rotation for printing color images having a resolution of 60 dots per centimeter. The print head is positioned by a stepper motor coupled to the print head by a cogged belt and requires about four minutes to print an image.

Referring to FIG. 1, a reciprocating print head positioning example is described in U.S. Pat. No. 5,227,809 issued Jul. 13, 1993 for AUTOMATIC PRINT HEAD SPACING MECHANISM FOR Ink-jet PRINTER, assigned to the assignee of this application, in which an ink-jet printer 10 requires two minutes to print a 120 dot per centimeter color image. An ink-jet print head assembly 12 supports a print head 14 having 96 orifices from which ink droplets are ejected toward a print medium 16 that is mounted on a drum 20. Print medium 16 is fed through a pair of media feed rollers 22*a* and 22*b* and secured to drum 20 by a media securing system 24. Securing system 24 includes a media clamp 26 that receives and clamps a leading end of print medium 16 against drum 20. Media clamp 26 slides into and remains stationary within a slot 28 in drum 20.

A drum motor (not shown) incrementally rotates drum 20 in a direction 34 about an axis 36 of drum 20, thereby pulling print medium 16 through media feed rollers 22*a* and 22*b* and under a back tension blade 38 that is spring biased toward drum 20. Print medium 16 slides under and is held against drum 20 by back tension blade 38 as drum 20 rotates.

A print head positioning system 50 includes a carriage 52 slidably mounted on a pair of guide rails 54*a* and 54*b* and supporting print head assembly 12. A carriage drive belt 56 is attached to carriage 52 and held under tension by a pair of belt pulleys 58*a* and 58*b*. A carriage stepper motor 60 linked to pulley 58*a* drives carriage 52 in directions 62*a* and 62*b* along guide rails 54*a* and 54*b*. When printing images on print medium 16, the drum motor incrementally rotates drum 20 about axis 36 while carriage motor 60 bidirectionally drives carriage 52 along guide rails 54*a* a and 54*b* and a printer controller 70 delivers print control signals to a control input 72 of print head 14 which ejects ink droplets toward print medium 16. The print control signals are delivered to print head 14 while carriage 52 is driven in both directions 62*a* and 62*b*, thereby providing bidirectional printing in which successive bands of image lines are printed alternately in directions 62*a* and 62*b* by the multiple nozzles of print head 14.

Printer 10 suffers from a number of disadvantages including a complex print medium handling mechanism, susceptibility to bidirectional dot misconvergence, and a relatively slow printing speed.

Printing speed can be increased by increasing the number of nozzles in print head 14, but even with 124 nozzles, printer 10 still requires one minute to print an image.

Printing speed can also be increased by increasing the velocity at which carriage 52 reciprocates back-and-forth in directions 62*a* and 62*b*. However, drop convergence problems increase with carriage speed, and positioning accuracy decreases because of dynamic positioning problems associated with rapidly moving the relatively massive ink-jet print head assembly 12.

Prior work directed to improving the speed and accuracy of reciprocating print head movement is described in U.S. Pat. No. 4,939,440 issued Jul. 3, 1990 for FRICTION-COMPENSATING MASS MOTION CONTROLLER, U.S. Pat. No. 4,957,014 issued Sep. 18, 1990 for CABLE DRIVE GEOMETRY, and U.S. Pat. No. 5,036,266 issued Jul. 30, 1991 for MASS VELOCITY CONTROLLER, all of which are assigned to the assignee of this application. Unfortunately, all the reciprocating print head positioning techniques are eletro-mechanically complex, costly, and do not really solve the printing speed, bidirectional convergence, or paper path complexity problems.

For the above-described reasons, a transfer printing process similar to one described in U.S. Pat. No. 4,538,156 issued Aug. 27, 1985 for Ink-jet PRINTER is desirable for increasing printing speed, eliminating bidirectional convergence problems, and reducing paper path complexity. A transfer printer employs a print media-width print head that ejects image forming droplets directly onto a rotating drum. After the drum is "printed," a print medium is placed in rolling contact with the drum such that the image is transferred from the drum to the print medium.

FIG. 2 shows that the transfer printer includes a transfer drum 80 rotated by a motor 82 in a direction indicated by an arrow 84. A print head assembly 86 includes a frame 88, guide bars 90 and 92, a nozzle array 94, a stepper motor 96, a belt 98, and a lateral positioning assembly 100. An ink reservoir 102 is connected to nozzle array 94 by a tube 104.

The transfer printer also includes a print media supply surface 106, a printing pressure roller 108, and a drum cleaning assembly 110. A drum cleaning web 112 and transfer drum 80 are brought into contact by a roller 114 that is moved toward transfer drum 80 in proper time relationship with movement of printing pressure roller 108. Cleaning web 112 prepares the surface of transfer drum 80 to receive the ink drops from nozzle array 94.

Nozzle array 94 is a print media-width linear array of nozzles spaced apart by 0.254 millimeter to print a 79 dot per centimeter resolution image on drum 80 during 20 successive rotations of transfer drum 80. The image on transfer drum 80 is transferred when a print medium 115 is advanced into a nip formed between printing pressure roller 108 and transfer drum 80.

Transfer drum 80, print head assembly 86, and drum cleaning assembly 110 are mounted between two frame plates of which only a right-hand plate 116 is shown.

FIG. 3 shows lateral positioning assembly 100 in greater detail. Stepper motor 96 incrementally moves print head assembly 86 to access successive printing tracks on transfer drum 80. Thereby, nozzle array 94 is moved laterally on guide rods 90 and 92 under the influence of the lateral motion assembly 100. The rotation of stepper motor 96 is transferred to a shaft 120 by belt 98 and a pulley 122. Threads 124 on shaft 120 engage internal threads 126 on a nut 128. Nut 128 and a body 130 are held in a fixed relationship by splines (not shown) and by a spring 132.

The printing tracks on transfer drum 80 are successively accessed by energizing stepper motor 96 for a predetermined number of steps sufficient to achieve the desired lateral motion of the print head assembly 86. After each nozzle of nozzle array 94 has printed all tracks of a corresponding succession of tracks, stepper motor 96 is reversed to cause body 130 and print head assembly 86 to return to an initial printing position. A return spring 134 cooperates with spring 132 to ensure accurate positioning of nozzle array 94 by eliminating play in the meshing of threads 124 on shaft 120 with internal threads 126 on nut 128. Body 130 of lateral motion assembly 100 is moved laterally on guide rods 136 and 138. Lateral movement of body 130 is coupled by a pin 140 to a tab 142 that is attached to print head assembly 86.

The above-described transfer printer is advantageous because of rapid unidirectional printing, constant print head to media spacing, insensitivity to print media thickness, and a greatly simplified "straight through" paper path.

However, lateral motion assembly 100 is relatively complex, expensive, and unable to uniformly, accurately, and repeatably position a print head assembly with a nozzle array capable of printing 118 dot per centimeter images. This is because anti-backlash springs 132 and 134, belt 98, pulley 122, threads 124 and 126, and guide rods 90, 92, 136 and 138 cause an unacceptable degree of friction and dimensional tolerance buildup that causes "print banding" in high-resolution images. Moreover, the stepper motor- and lead-screw-based print head positioner is not readily adjustable to compensate for the friction and tolerance buildups.

What is needed, therefore, is a print head assembly positioner that is simple, adjustable, free of most friction and backlash, and capable of reliably supporting high-resolution printing applications without visible print banding or other print artifacts.

SUMMARY OF THE INVENTION

An object of this invention is, therefore, to provide an apparatus and a method for accurately, repeatably, and reliably positioning a print head assembly relative to a print medium.

Another object of this invention is to provide a simple, adjustable, and relatively friction- and backlash-free apparatus and method for positioning a print head assembly relative to a print medium.

A further object of this invention is to provide an apparatus and a method for positioning a print head assembly relative to a print medium such that high-resolution printing is achieved without visible print banding or other print artifacts.

Accordingly, this invention provides a stepper motor coupled by a substantially friction- and backlash-free taut metal band to a lever arm that imparts precise lateral motion to a positioning shaft that is rigidly attached to the print head assembly. Each step of the stepper motor is translated by the lever arm into one pixel (0.085 millimeter) of lateral movement of the shaft. The exact amount of translation per step of the stepper motor is adjustable by an eccentrically mounted ball that is minutely positionable on the lever arm. The ball couples angular motion of the lever arm to lateral motion of the shaft such that adjusting the ball position on the lever arm provides a variable scale factor adjustment that compensates for tolerance buildups and exact inter-nozzle spacing on the print head. The shaft is biased toward the ball by a spring. The shaft further allows the print head to swing away from a print media support, such as a drum, for maintenance.

Additional objects and advantages of this invention will be apparent from the following detailed description of a preferred embodiment thereof that proceeds with reference to the accompanying drawings.

DETAILED DESCRIPTION OF PREFERRED EMBODIMENT

Figure 1:
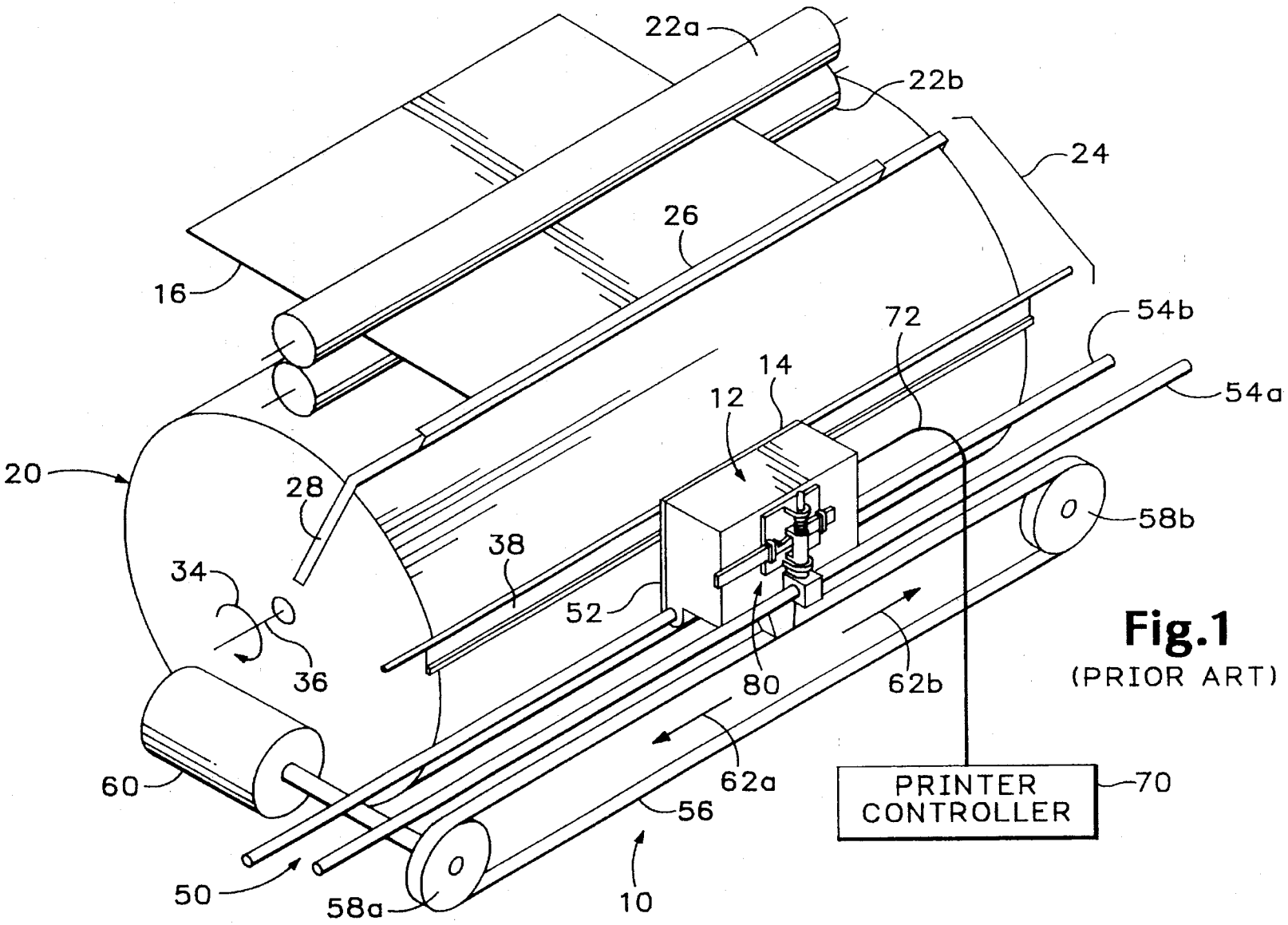
Fig.1 (PRIOR ART)
FIG. 1 is a simplified isometric view of a prior art ink-jet printer showing a print medium support drum and a reciprocating print head positioning system.
Figure 2:
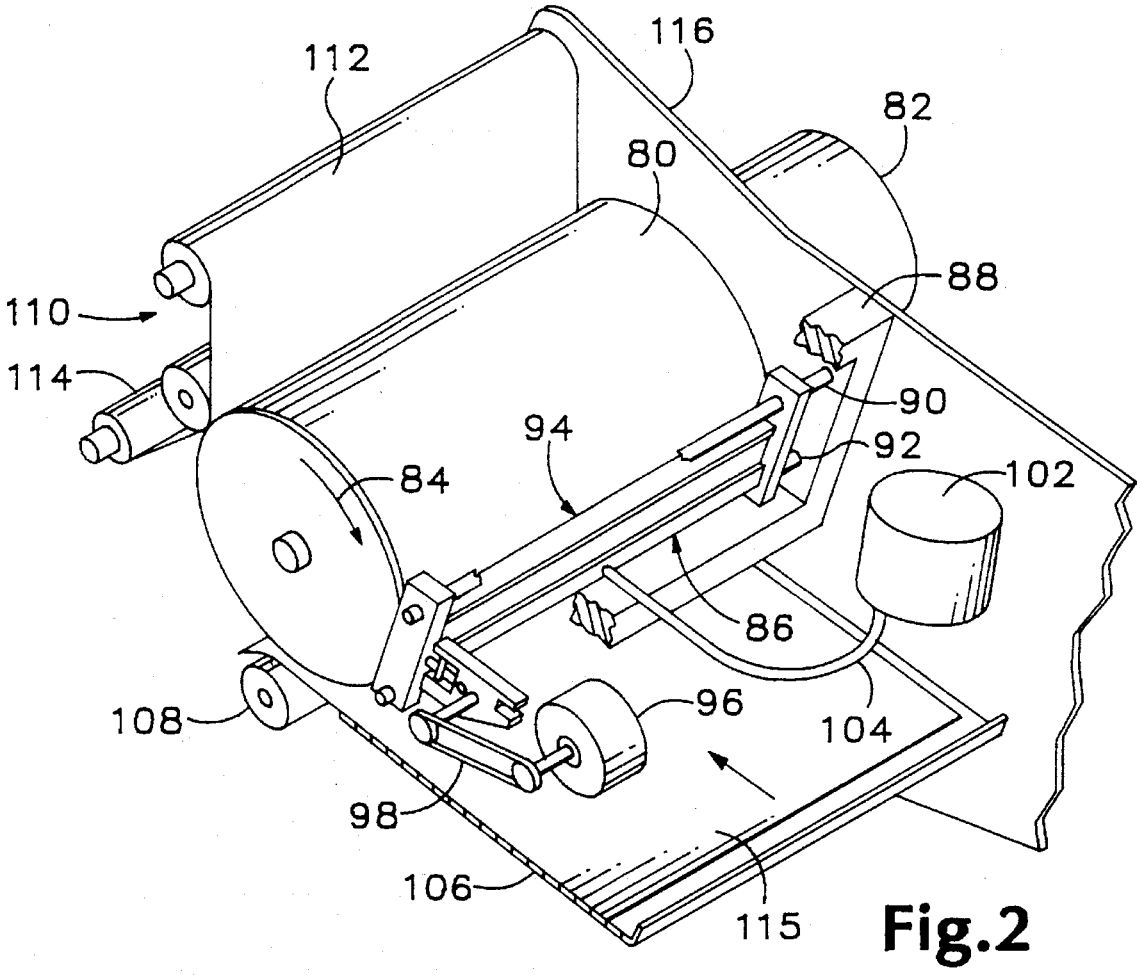
Fig.2 (PRIOR ART)
FIG. 2 is a simplified isometric view of a prior art ink-jet transfer printer showing a transfer drum, a print media-width print head assembly, and a lateral print head positioning system.

The need for precise positioning of a print head assembly relative to a print medium is described below with reference to FIGS. 4A and 4B. An adjacent pair of nozzles 150 and 152 are part of a larger nozzle array, such as nozzle array 94 of FIG. 2. Nozzles 150 and 152 are spaced apart by a predetermined distance that is typically dictated by a desired printing resolution but limited by print head manufacturing capabilities. Therefore, nozzle spacing is typically some integer multiple of the desired printing resolution.

Figure 4A:
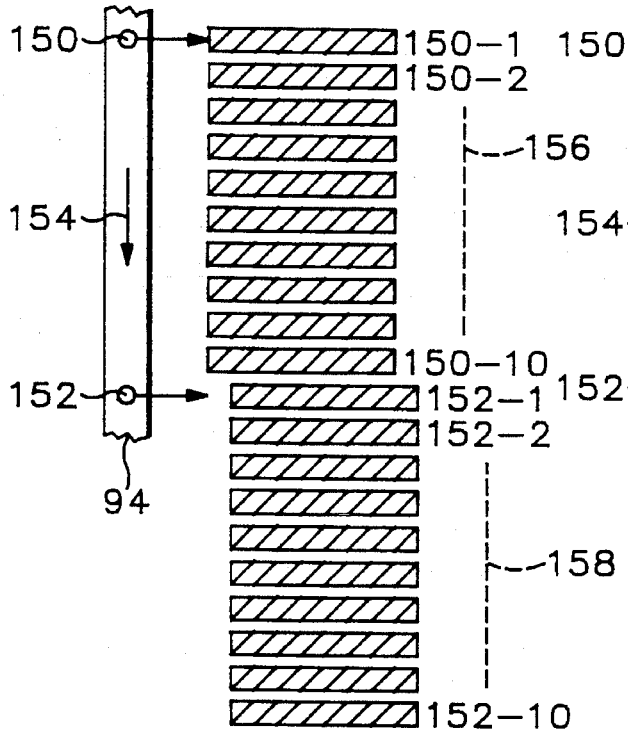
FIGS. 4A and 4B are enlarged schematic pictorial views representing two adjacent ink-jet nozzles moved respectively in properly and improperly proportioned increments to print noninterlaced bands of ink on a moving print medium.

In the example of FIG. 4A, the inter-nozzle spacing is 10 pixel widths. A conventionally scanned transfer printing process entails ejecting ink drops toward the surface of a rotating drum and detecting a rotational index position that is used to start printing on the drum surface at the same angular position for successive rotations of the drum. During a first drum rotation, nozzles 150 and 152 print respective first scan lines 150-1 and 152-1 after which nozzle array 94 is moved exactly one pixel width in a direction indicated by arrow 154. Alternatively and preferably, nozzle array 94 is smoothly moved by one pixel width during the time of each drum rotation. During a second drum rotation, nozzles 150 and 152 print respective second scan lines 150-2 and 152-2 after which nozzle array 94 is again moved exactly one pixel width. This process repeats eight more times until during a tenth drum rotation, nozzles 150 and 152 print respective tenth scan lines 150-10 and 152-10 after which nozzle array 94 is moved back to its original starting position. Finally, the image printed on the drum is transferred to a print medium.

The ten scan lines printed by nozzle 150 form a first print band 156, and the ten scan lines printed by nozzle 152 form a second print band 158. Print bands 156 and 158 are shown laterally offset to clearly differentiate them from each other. The lateral offset does not necessarily represent actual printing. As shown in FIG. 4A, when nozzle array 94 is moved in exactly one pixel increments, the spacing between scan lines equals the spacing between print bands 156 and 158, resulting in uniform printing without a banding artifact.

Figure 4B:
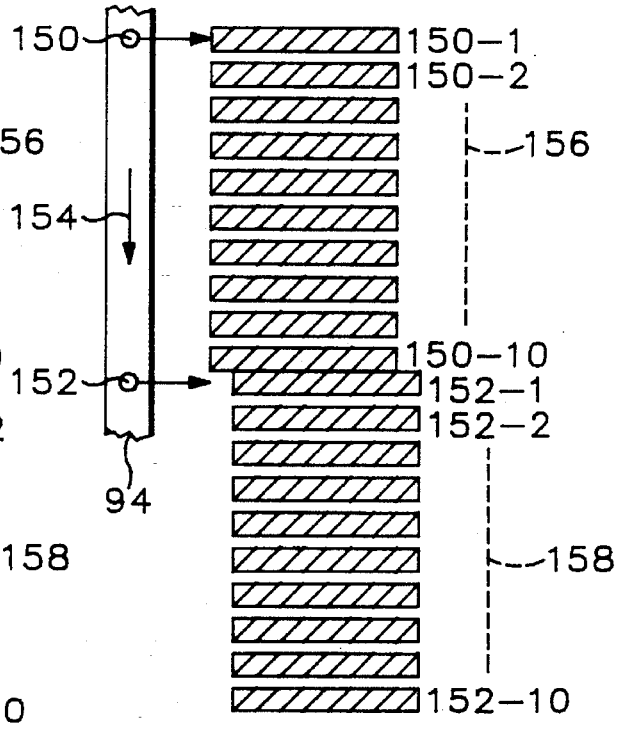

However, FIG. 4B shows what happens when nozzle array 94 is moved slightly more than one pixel per drum rotation. The scan line spacing error accumulates such that scan line 150-10 of first print band 156 overlaps scan line 152-1 of second print band 158. Because the modulation transfer function of the human eye is very sensitive to small lateral displacements, band-to-band spacing errors of only one-tenth of a pixel diameter produce a clearly visible and objectionable "banding" artifact such as the one represented in FIG. 4B. Such banding is repeated across the full width of nozzle array 94 at each neighboring pair of print bands and is visible whether the spacing error causes scan line overlap or underlap.

Figure 5A:
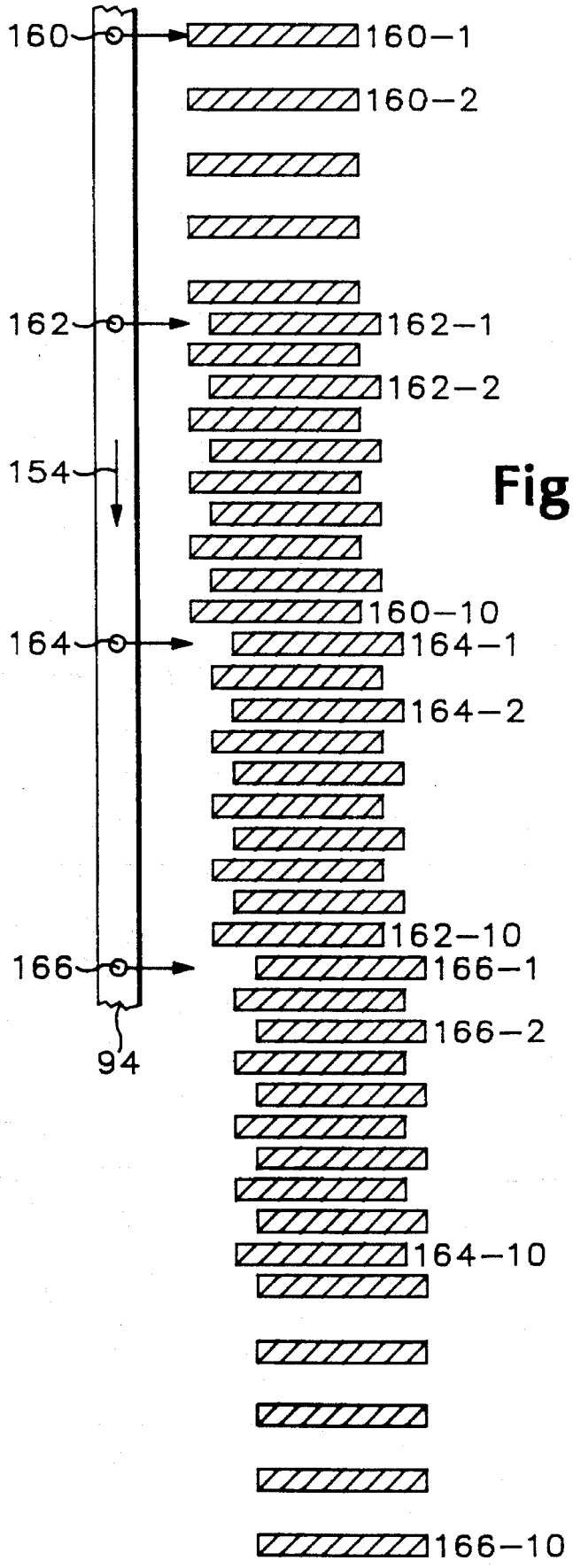
FIGS. 5A and 5B are enlarged schematic pictorial views representing four adjacent ink-jet nozzles moved respectively in properly and improperly proportioned increments to print interlaced bands of ink on a moving print medium.
Figure 5B:
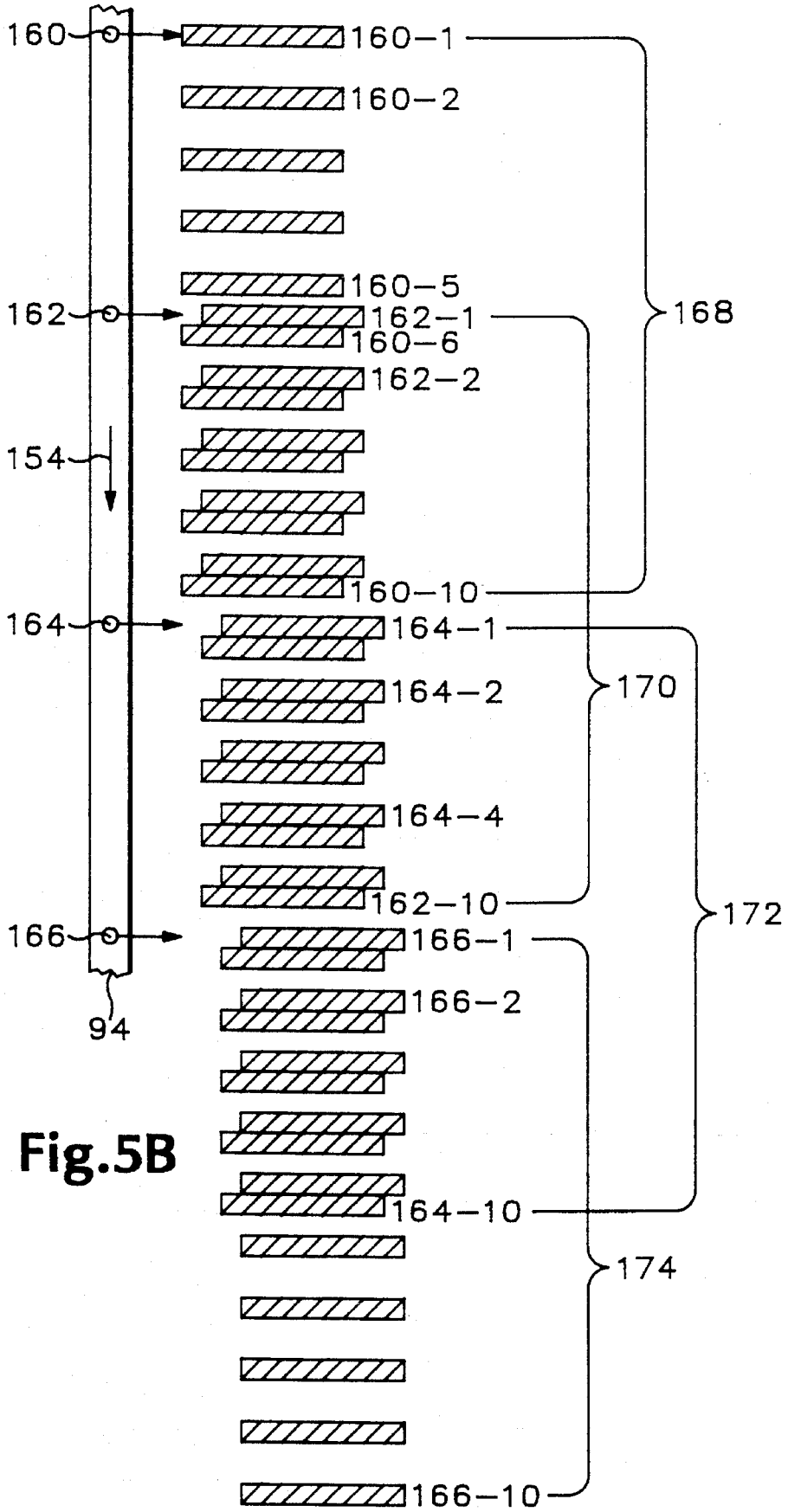

FIGS. 5A and 5B show the effects of proper and improper nozzle array positioning when printing an interlaced image. Interlaced printing is commonly employed in ink-jet printers to allow a first printed set of scan lines to dry or set before an adjacent set of scan lines are printed, thereby preventing the ink of adjacent scan lines from bleeding together.

In the interlaced printing example of FIG. 5A, the inter-nozzle spacing is 10 pixel widths. During a first drum rotation, nozzles 160, 162, 164, and 166 print respective first scan lines 160-1, 162-1, 164-1, and 166-1 after which nozzle array 94 is moved exactly two pixel widths in the direction indicated by arrow 154. Alternatively and preferably, nozzle array 94 is smoothly moved by two pixel widths during the time of each drum rotation. During a second drum rotation, nozzles 160, 162, 164, and 166 print respective second scan lines 160-2, 162-2, 164-2, and 166-2 after which nozzle array 94 is again moved exactly two pixel widths. This process repeats eight more times until during a tenth drum rotation nozzles 160, 162, 164, and 166 print respective tenth scan lines 160-10, 162-10, 164-10, and 166-10 after which nozzle array 94 returns to its original starting position.

The ten successive scan lines printed by nozzles 160, 162, 164, and 166 form respective first through fourth print bands 168, 170, 172, and 174. As in the prior example, the print bands are shown laterally offset to clearly differentiate them from each other. As shown in FIG. 5A, when nozzle array 94 is moved in exactly two pixel increments, the spacing between interlaced scan lines is equal, even in regions where print bands overlap.

However, FIG. 5B shows the banding artifacts that result when nozzle array 94 is moved slightly less than two pixels per drum rotation. The scan line spacing error accumulates such that scan lines 160-5 and 160-6 of first print band 168 are unevenly spaced apart from scan lines 162-1 and 162-2 of second print band 170. Also, scan line 164-4 of print band 172 overlaps scan line 162-10 of print band 170. Once again, such banding artifacts are repeated across the full width of a nozzle array.

Figure 6:
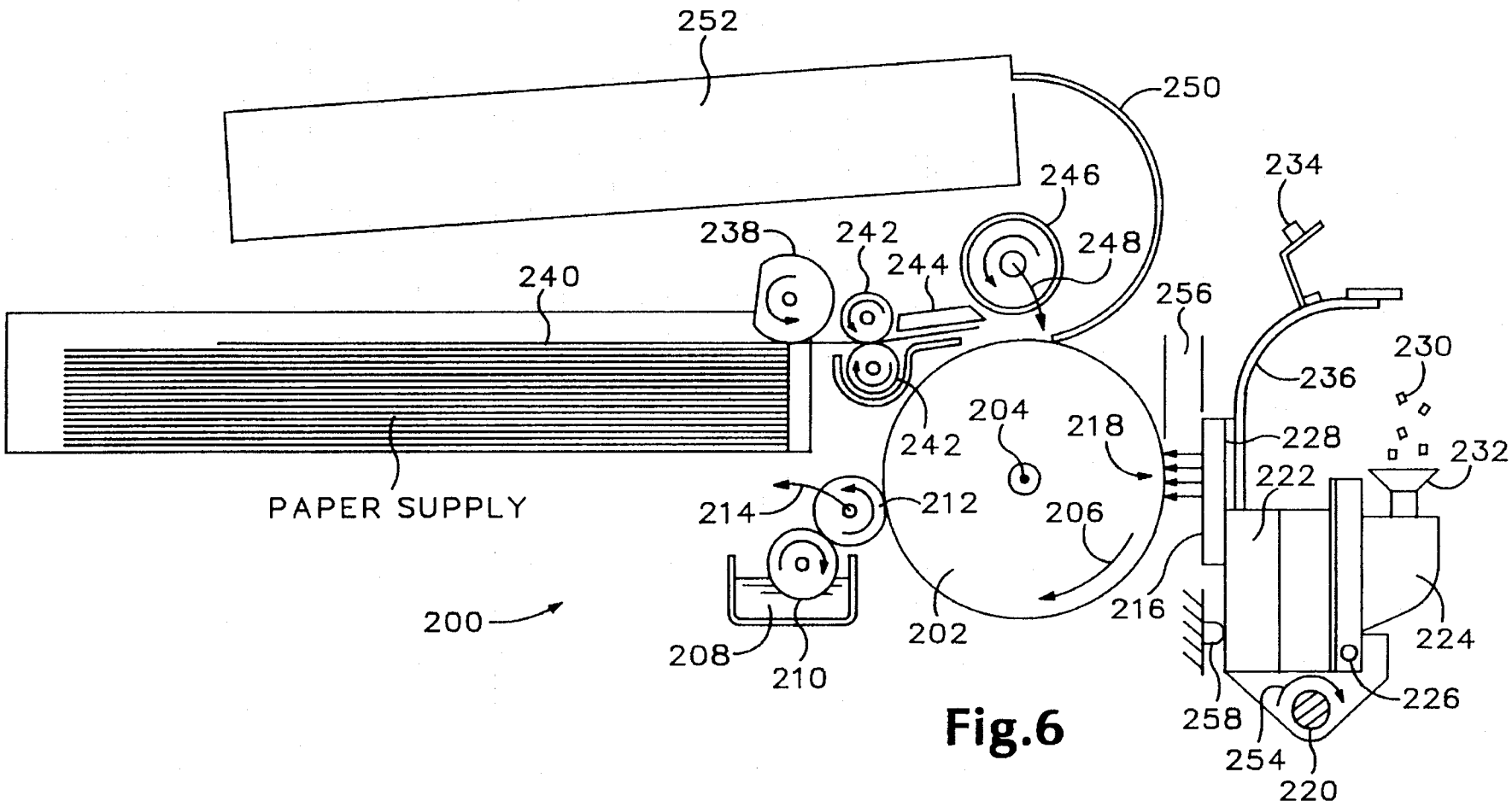
FIG. 6 is a simplified side pictorial view showing an image transfer ink-jet printer, such as one employing this invention.

Referring to FIG. 6, a transfer printing phase-change ink-jet printer 200 (hereafter "printer 200") suitable for use with this invention prints an image according to the following sequence of operations.

A transfer drum 202 rotates about an axis of rotation 204 in a direction indicated by arrow 206. Prior to printing, drum 202 is wetted with a transfer fluid 208 by transfer fluid applicator rollers 210 and 212 after which transfer fluid applicator roller 212 is moved away from drum 202 in the direction of arrow 214. Preferably, transfer fluid 208 is selectively applied to drum 202 with a movable wick. An ink-jet print head 216 spans the width of drum 202 with four vertically spaced apart nozzle arrays (shown generally at 218). Nozzle arrays 218 eject, respectively, yellow Y, magenta M, cyan C, and black K colored phase-change ink. (When necessary hereafter, numbered elements will be further identified by a letter indicating the color of ink carried by the element. For example, nozzle array 218C is a cyan ink ejecting nozzle array.)

Nozzle arrays 218 each have nozzles spaced apart horizontally by 2.37 millimeters (28×0.0847 millimeter pixel spaces) to provide a 118 dot per centimeter printing resolution. Each array of nozzle arrays 218 is aligned parallel with axis of rotation 204, and nozzle arrays 218Y, 218M, and 218C are aligned vertically such that corresponding nozzles in each array print on the same scan line. Nozzle array 218K is offset horizontally by two pixel spaces from corresponding nozzles in the other arrays.

Printing a preferred interlaced image pattern on drum 202 entails moving print head 216 in 27 increments (one during each rotation of drum 202). The 27 increments include 13 two-pixel increments, one three-pixel increment, and 13 more two-pixel increments that together move print head 216 a total lateral distance of 55 pixels (4.656 millimeters), which is two pixels short of the inter nozzle spacing in order to prevent over-printing a previously printed scan line. The three-pixel print head increment is necessary to provide proper interlacing with the preferred nozzle spacing in print head 216.

Figure 3:
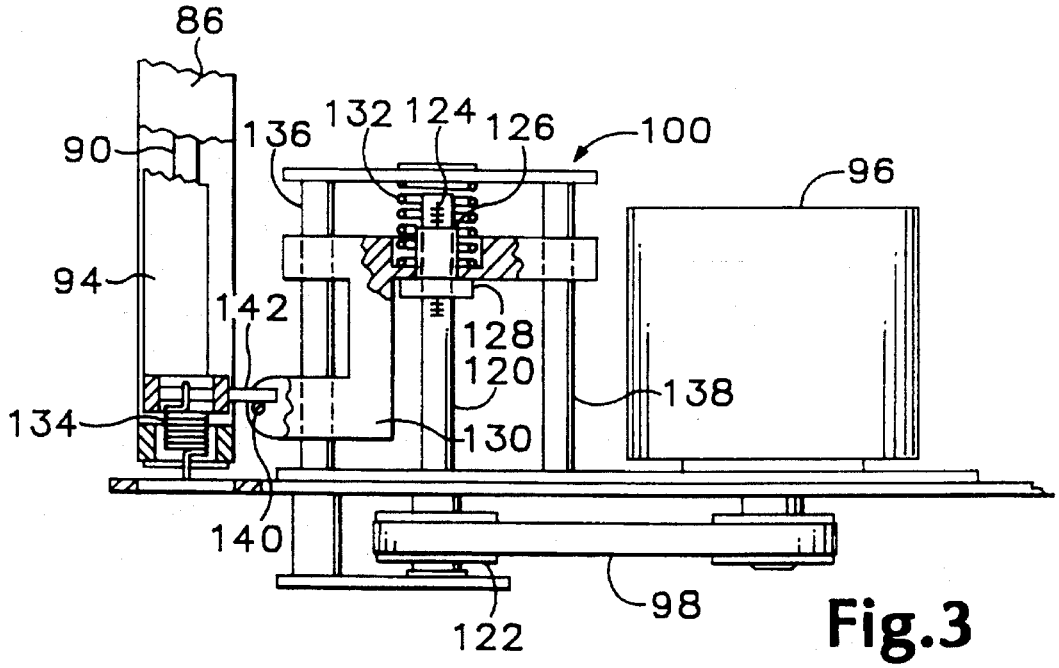
Fig.3 (PRIOR ART)
FIG. 3 is an enlarged top view of the print head positioning system of FIG. 2 showing stepper motor, pulley, belt, lead screw, nut, body, and print head assembly coupling details thereof.

In printer 200 a one-tenth pixel positioning error of only eight microns creates visible banding artifacts. Conventional print head positioning mechanisms, such as the lead screw shown in FIG. 3, do not provide the required positioning accuracy or repeatability. Moreover, it is expensive, if not impossible, to design and build mechanical parts that provide better than eight micron print head positioning accuracy. Therefore, some form of print head positioning scale factor adjustment must be employed by which the fixed angular steps of a stepper motor are converted into adjustably changeable lateral movements of the print head.

The required lateral movement is accomplished by securing print head 216 (and associated components) to a shaft 220 that is moved laterally by a print head positioner described with reference to FIGS. 7, 8, and 9.

Print head 216, preferably of a type that ejects phase-change ink, is therefore mounted to an ink reservoir 222 which, together with four ink premelt chambers 224 (one shown), is secured to shaft 220. Reservoir 222 and premelt chambers 224 are heated by a reservoir heater 226, and print head 216 is separately heated by a print head heater 228. Four colors of solid phase-change inks 230 (one color shown) are fed through four funnels 232 (one shown) to premelt chambers 224 where solid inks 230 are melted by reservoir heater 226 for distribution to print head 216.

Piezoelectric transducers positioned on print head 216 receive image data from drivers 234 mounted on a flex circuit 236. Print head 216 ejects controlled patterns of cyan, yellow, magenta, and black ink toward rotating drum 202 in response to the image data thereby depositing a complete image on the wetted surface of drum 202 during 27 sequential rotations of the drum.

A media feed roller 238 delivers a print medium 240 to a pair of media feed rollers 242 which advance print medium 240, such as plain paper or transparency film, past a media heater 244 and into a nip formed between drum 202 and a transfer roller 246. Transfer roller 246 is moved into pressure contact with drum 202 as indicated by an arrow 248. A combination of pressure in the nip and heat from print medium 240 causes the deposited image to transfer from drum 202 and fuse to print medium 240. Image transferring heat is also provided by heating drum 202. Printed print medium 240 advances into an exit path 250 from which it is deposited in a media output tray 252.

After the image transfer is completed, transfer roller 246 moves away from drum 202 and transfer fluid applicator roller 212 moves into contact with and conditions drum 202 for receiving another image.

To maintain print quality, print head 216 requires periodic cleaning and purging by a print head maintenance station (not shown). Print head maintenance is normally accomplished following cold start-up of printer 200 and proceeds by rotating print head 216 on shaft 220 away from drum 202 in a direction indicated by an arrow 254. When print head 216 is a sufficient distance from drum 202, the maintenance station is moved into a position adjacent to print head 216. After maintenance, print head 216 is rotated back to a printing distance 256 that is determined by a stop 258 against which ink reservoir 222 slidably rests.

Figure 7:
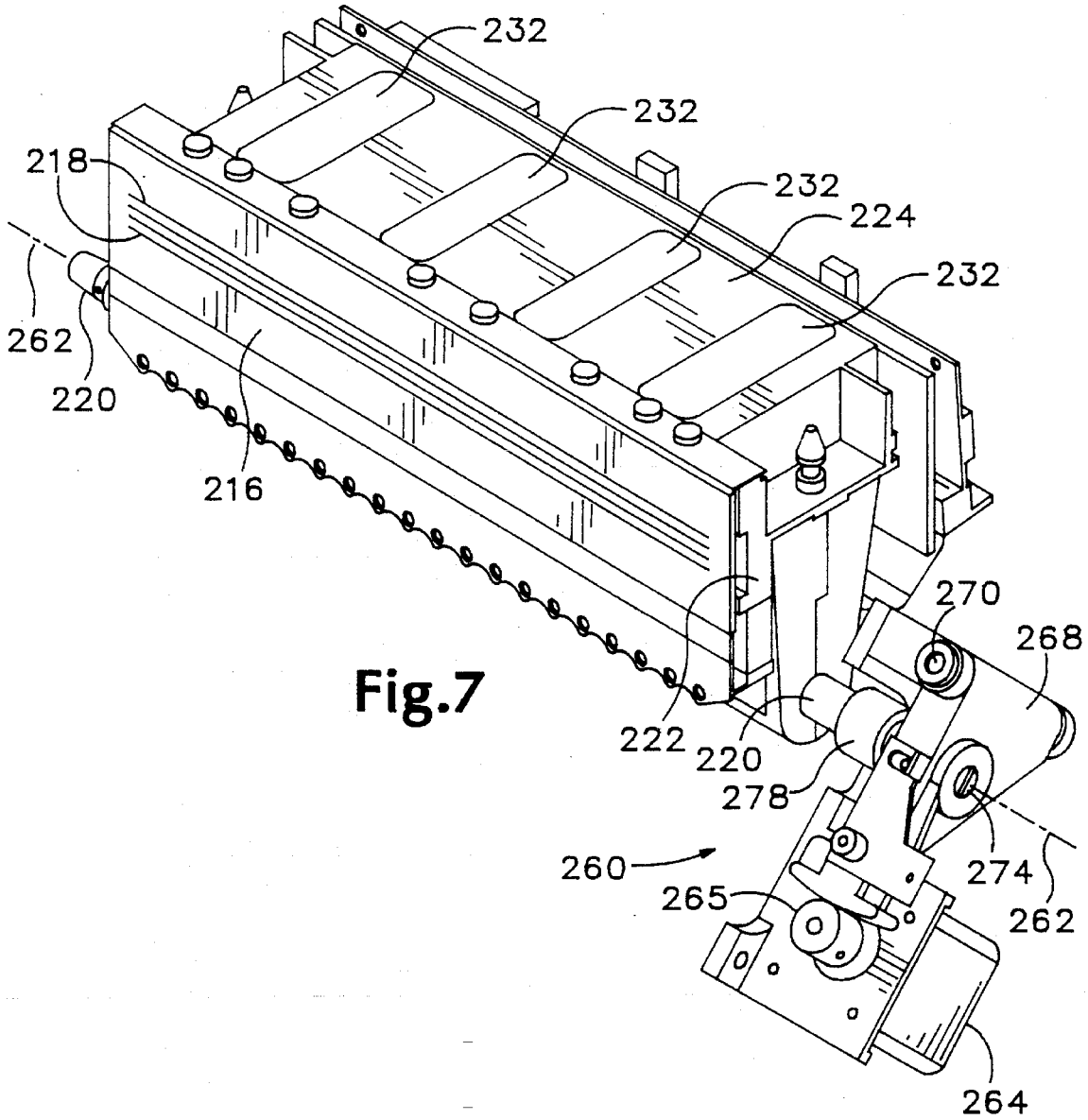
FIG. 7 is an isometric pictorial diagram showing a print head positioning mechanism according to this invention.
Figure 8:
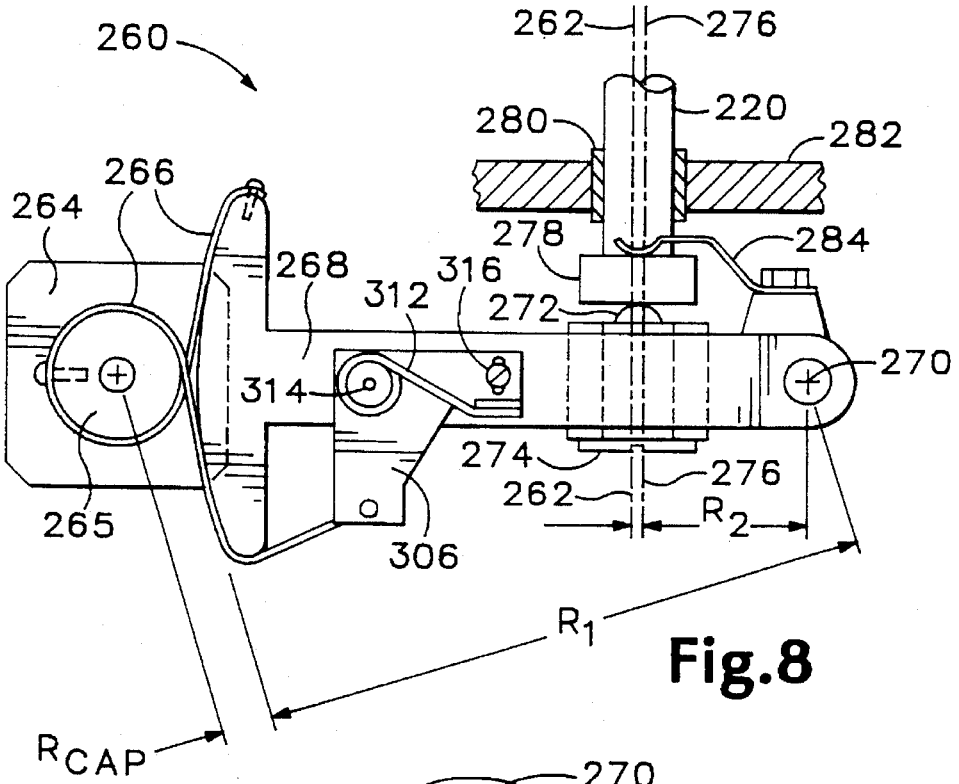
FIG. 8 is a top pictorial view showing the operative geometric relationships among a stepper motor, capstan, taut metal band, lever arm, and shaft employed by the print head positioner of FIG. 7.

Referring to FIGS. 7 and 8, a print head positioner 260 laterally moves print head 216 incrementally along a longitudinal axis 262 of shaft 220. A stepper motor 264 is coupled by a capstan 265 and a taut metal band 266 (hereafter "band 266") to a lever arm 268 that rotates on a pivot shaft 270. Lever arm 268 includes a ball contact 272 mounted in an eccentric drive 274 such that a ball axis 276 is minutely positionable relative to longitudinal axis 262 by rotating eccentric drive 274. Rotationally angular increments of stepper motor 264 are converted to corresponding angular increments of lever arm 268 and thereby to corresponding lateral translational movements of shaft 220 by means of ball contact 272. The end of shaft 220 adjacent to lever arm 268 includes a hardened metal flat 278 that abuts ball contact 272. Shaft 220 slides in a shaft bearing 280 that is mounted in a mounting plate 282. A keeper spring 284 biases shaft 220 toward ball contact 272 to maintain contact therewith.

FIG. 8 shows how print head positioner 260 meets the following preferred positioning requirements:

- one step of stepper motor 264 must translate into one pixel (0.085 millimeter) of longitudinal movement of shaft 220;
- eccentric drive 275, ball contact 272, and flat 278 must provide a variable scale factor that compensates for dimensional inaccuracies of associated components and inexact inter-nozzle spacings in nozzle arrays 218; and
- shaft 220 must freely rotate to facilitate maintenance of print head 216.

Stepper motor 265 is preferably a two-phase hybrid stepper motor, such as model PK-224 manufactured by Oriental Motors Co., Takamatsu, Japan, which provides 200 1.8-degree steps per revolution.

Capstan 265 has a 7.874 millimeter (0.31 inch) pitch radius $R_{cap}$ that is measured from its center to halfway through the 0.050 millimeter (0.002 inch) thickness of band 266 at a tangent point where band 266 leaves capstan 265. Lever arm 268 has a 74.22 millimeter (2.922 inch) pitch radius $R_1$ that is measured from the center of pivot shaft 270 to halfway through the 0.050 millimeter thickness of band 266 at a tangent point where band 266 leaves radius end 302 of lever arm 268 and a nominal 25.40 millimeter (1,000 inch) contact radius $R_2$ that is measured from the center of pivot shaft to ball axis 276. Overall dimensions for $R_1$, $R_{CAP}$, and nominal $R_2$are chosen based on space availability and other limitations. Specific dimensions for lever arm radii $R_1$ and $R_2$ are chosen, and $R_2$ is adjustable such that one incremental step of stepper motor 264 equals one pixel space. Capstan 265 is pressed on the shaft of stepper motor 264, positioned to minimize runout with respect to the rotational axis of stepper motor 264, and secured with a compound, such as Loctite®.

Using the above-described dimensions, the dimension of lateral movement of shaft 220 for each angular increment ($2\pi/200$ radians) of stepper motor 264 is calculated as:

$(2\pi/200)(7.874)(25.4/74.22)=0.085$ millimeter, which is one 118 dot per centimeter pixel, or in inches as $(2\pi/200)(0.31)(1.000/2.922)=0.003333$ inch, which is one 300 dot per inch pixel.

The scale factor is adjustable by rotating eccentric drive 274 in lever arm 268 to vary the position of ball axis 276, thereby changing the ratio of $R_1$ to $R_2$. The preferred maximum offset of ball axis 276 in either direction from longitudinal axis 262 is 0,635 millimeters (0.025 inch).

Figure 9:
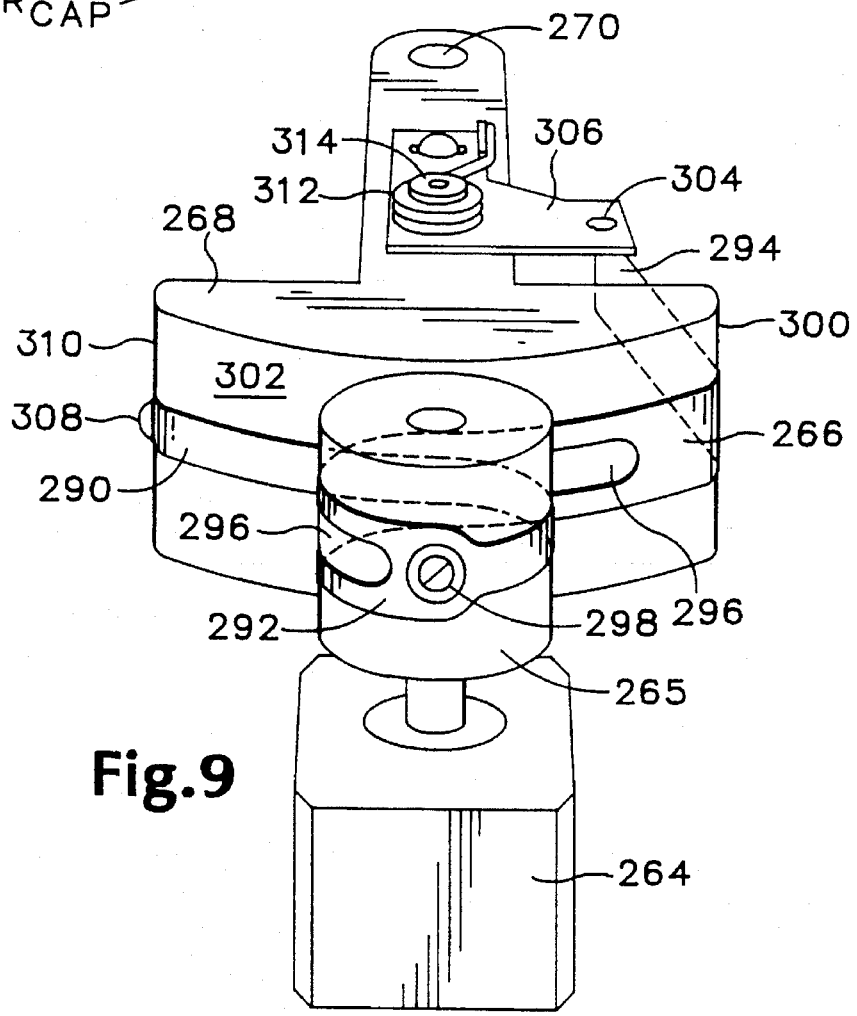
FIG. 9 is an isometric pictorial view of print head positioner components of FIG. 8 showing how the taut metal band couples the stepper motor to the lever arm.

FIG. 9 shows how band 266 couples capstan 265 to lever arm 268. A taut metal band was first used in 1979 to couple a stepper motor to a magnetic read/write head track selector in a "Mayflower" disk drive manufactured by MFE, Inc., Salem, Massachusetts, and has become a commonly used technique in floppy disk drives. Band coupling provides very low friction, high positional accuracy and repeatability, and substantially zero backlash. Band 266 is fabricated from 0.050 millimeter (0,002 inch) thick 11R51 stainless steel manufactured by Sandvik Steel Corp., Benton Harbor, Mich. 11R51 steel is preferred for its very high fatigue resistance.

Band 266 is punched from a sheet of 11R51 steel in an elongated shape having a first arm 290, a center portion 292, and a second arm 294 that includes a slot 296 through which first arm 290 can freely pass.

Band 266 is firmly attached to capstan 265 by a fastener 298, and second arm 294 is wrapped about one-half turn clockwise (looking from the top) around capstan 265, routed around a first end 300 of a radius end 302 of lever arm 268, and fastened to a pin 304 on a band tensioning arm 306. First arm 290 is wrapped about one-half turn counter-clockwise around capstan 265, routed through slot 296, and securely fastened by a fastener 308 to a second end 310 of radius end 302 on lever arm 268. The spacing between capstan 265 and radius end 302 is only slightly larger than the clearance required by band 266.

Also referring to FIG. 8, a band tensioning spring 312 is adjusted by rotating band tensioning arm 306 about shaft 314 until band 266 has about 1.82 kilograms of tension. Band tensioning arm 306 is then secured to lever arm 268 by a fastener 316 to effectively remove spring 312 from the dynamically moving system of print head positioner 260.

Print head positioner 260 is shown in its nominally centered position. However, a printing cycle normally begins with shaft 220 translated by lever arm 268 to a starting end of its travel that is associated with an index position. The index position may be detected by one of many conventional means, such as a microswitch or electro-optical sensor coupled to stepper motor 264, lever arm 268, shaft 220, or print head 216.

Skilled workers will recognize that portions of this invention may have alternative embodiments. For example, another scale factor may be chosen to suit a particular application, the radii chosen may be different for a particular scale factor, and the scale factor adjustment may be provided by moving the entire print head positioner 260 relative to shaft 220. Also, nonstepping positioners such as servo motors, voice coils, or linear motors may be employed, and print head 216 may be mounted on flexures rather than shaft 220. Coupling the motor to lever arm 268 may employ a cam, worm drive, friction drive, or gears, albeit with some undesirable amount of friction and backlash and wear.

It will be obvious to those having skill in the art that many changes may be made to the details of the above-described embodiments of this invention without departing from the underlying principles thereof. Accordingly, it will be appreciated that this invention is also applicable to precision positioning applications other than those found in phase-change ink-jet printers. The scope of the present invention should, therefore, be determined only by the following claims.

We claim:

1. An improved print head positioner in a printer of a type in which a print medium scans in a first direction and a print head has an array of marking means uniformly spaced apart in a second direction for printing correspondingly spaced apart indicia on the print medium, and in which the print head is moved a predetermined distance in the second direction by a print head positioner for each of a predetermined number of print medium scans to print the print medium, the improved print head positioner comprising:

an input motion means for imparting a first amount of motion to the print head positioner for each scan of the print medium;

an adjustable scale factor means for providing a scale factor to move the print head in adjustably changeable lateral movements the predetermined distance, the scale factor means being coupled by a first coupling means to the input motion means; and an output motion means coupled by a second coupling means to the adjustable scale factor means for imparting the predetermined distance to the print head;

whereby the scale factor is adjustable to accurately convert the first amount of motion into the predetermined distance such that the indicia are uniformly spaced apart in the second direction on the print medium after the predetermined number of print medium scans.

2. The printer of claim 1 in which the marking means are ink-jet nozzles.

3. The printer of claim 1 in which the indicia are uniformly spaced apart in the second direction on the print medium after the predetermined number of print medium scans by a distance of less than about 0.1 millimeter.

4. The printer of claim 1 in which the first direction and the second direction are substantially orthogonal directions.

5. The printer of claim 1 in which the input motion means is a stepper motor having a capstan.

6. The printer of claim 5 in which the first coupling means is a metal band that is secured to the capstan and to the adjustable scale factor means.

7. The printer of claim 1 in which the adjustable scale factor means is a lever arm having a pivot from which first and second radii are measured, the input and output motion means being coupled to the lever arm at distances from the pivot corresponding to respective ones of the first and second radii.

8. The printer of claim 7 in which the scale factor is adjustable by mechanically adjusting any combination of the first and second radii.

9. The printer of claim 7 in which the output motion means is a ball contact positionably coupled to the lever arm at a distance from the pivot corresponding to the second radius.

10. The printer of claim 9 in which the ball contact is positionally coupled to the lever arm by securing the ball contact to an eccentric drive rotation of which changes the distance of the second radius.

11. The printer of claim 9 in which the output motion means is a shaft having a flat surface on an end thereof that is slidably biased toward the ball contact.

12. The printer of claim 11 in which the print head is secured to the shaft, and the shaft rotates on a longitudinal axis to allow the print head to move away from the print medium for maintenance.

13. A method of positioning a print head in a printer of a type in which a print medium scans in a first direction and the print head includes an array of marking means uniformly spaced apart in a second direction for printing correspondingly spaced apart indicia on the print medium, and in which the print head is moved a predetermined distance in the second direction for each of a predetermined number of print medium scans to print the indicia the print medium, the print head positioning method comprising:

providing an adjustable scale factor means for providing a scale factor to move the print head in adjustably changeable lateral movement;

imparting a first amount of motion to an input of the scale factor means for each scan of the print medium;

adjusting the scale factor associated with the scale factor means such that the first amount of motion is converted to the predetermined distance at an output of the adjustable scale factor means; and imparting from the output of the adjustable scale factor means the predetermined distance to the print head such that the indicia are uniformly spaced apart in the second direction on the print medium after the predetermined number of print medium scans.

14. The method of claim 13 in which the imparting a first amount of motion is carried out by a stepper motor that is coupled to the input of the scale factor means by a capstan and a taut metal band.

15. The method of claim 13 in which the providing step is carried out by a lever arm having a pivot from which first and second radii are measured, the input and output being coupled to the lever arm at distances from the pivot corresponding to respective ones of the first and second radii.

16. The method of claim 15 in which adjusting step further includes varying any combination of the first and second radii.

17. The method of claim 16 in which the varying step is carried out by a ball contact that is positionably coupled to the lever arm at a distance from the pivot corresponding to the second radius.

18. The method of claim 17 in which the varying step further includes securing the ball contact to an eccentric drive and rotating the eccentric drive to change the distance of the second radius.

19. The method of claim 17 in which the imparting from the output motion step further includes attaching the print head to a shaft with a flat surface on an end thereof, and biasing the shaft toward the ball contact.

20. The method of claim 19 further including rotating the print head about a longitudinal axis of the shaft to provide access to the array of marking means and maintaining the print head.

21. An improved print head positioner in a printer of a type having a print medium that is supported by a drum that rotates in a first direction around a longitudinal axis and a print head that has an array of ink-jet nozzles uniformly spaced apart parallel to the longitudinal axis to print correspondingly spaced apart indicia on the print medium, and in which the print head is moved by a print head positioner a predetermined distance parallel to the longitudinal axis for each rotation of the drum, the improved print head positioner comprising:

a lever arm having a pivot from which first and second radii are measured;

a stepper motor coupled by a capstan and a taut metal band to a point on the lever arm at a distance corresponding to the first radius;

a contact coupled to the lever arm at a point on the lever arm at a distance from the pivot corresponding to the second radius;

a shaft coupled to the print head that is slidably biased toward the contact; and an adjustable scale factor means for changing a ratio of the first and second radii to accurately convert fixed angular steps of the stepper motor into the predetermined distance of the print head such that the indicia are uniformly spaced apart on the print medium after the drum undergoes a sufficient number of rotations to print an image on the print medium.

* * * * *